US005853824A

United States Patent [19]

Liu

[11] Patent Number: 5,853,824

[45] Date of Patent: Dec. 29, 1998

[54] CRYSTAL BALL STRUCTURE WITH CHANGEABLE BALL APPEARANCE

[76] Inventor: Jack Liu, No. 3, Alley 202, Kao-Fon Rd., Hsin-Chu City, Taiwan

[21] Appl. No.: 678,604

[22] Filed: Jul. 15, 1996

[51] Int. Cl.[6] ..... G09F 19/00

[52] U.S. Cl. ..... 428/11; 40/455; 428/13; 446/297

[58] Field of Search ..... 428/11, 13, 14; 40/455; 446/267, 297, 298, 408

[56] References Cited

U.S. PATENT DOCUMENTS 5,070,633 12/1991 Liu ..... 428/11 X
5,090,144 2/1992 Liu ..... 428/11 X
5,131,175 7/1992 Liu ..... 40/410
5,254,026 10/1993 Kaiser ..... 428/13 X
5,286,535 2/1994 Hou ..... 428/13 X
5,555,656 9/1996 Liu ..... 40/411
5,700,964 12/1997 Liu ..... 446/298

*Primary Examiner*—Henry F. Epstein
*Attorney, Agent, or Firm*—Beveridge, DeGrandi, Weilacher & Young, LLP

[57] ABSTRACT

A crystal ball structure with changeable ball appearance having a base, a fixing base and a transparent box. A nose portion is used to combine the base and the fixing base to form an integral body that is separable from each other. An open end of the transparent box is connected with the rubber plug base. Accordingly, the base may be easily separated from the fixing base so that a card may also be inserted into or removed from the open end of the transparent box, thus the ball appearance is achieved.

9 Claims, 8 Drawing Sheets

CRYSTAL BALL STRUCTURE WITH CHANGEABLE BALL APPEARANCE

BACKGROUND OF THE INVENTION

The present invention is related to a crystal ball structure with changeable ball appearance, especially, to a crystal ball structure wherein different cards may be placed in the transparent box so the appearance of the ball may be changed.

DESCRIPTION OF THE PRIOR ART

In the design of the conventional decorative crystal ball, a decorative article is installed inside the ball, the kinds of the decorative article are classified into that with dynamic appearances and that with static appearance. However, because the decorative article is placed in the closed ball, no matter the decorative article is dynamic or static, the appearance can not be changed. Especially, the static appearance of crystal ball can not be changed any more, this is a disadvantage of said design.

SUMMARY OF THE INVENTION

A crystal ball structure with changeable ball appearance mainly comprising a base, a fixing base and a transparent box; wherein a nose portion is used to combine the base and the fixed base to form an integral body or as a detachable body, and the open end of said transparent is assembled on the rubber plug base of said transparent box. Accordingly, the base may be easily fetched out from the fixing base so that a card may also be inserted into or fetch out from the open end of the box, thus the change of ball appearance is achieved.

DETAIL DESCRIPTION OF THE PREFERRED EMBODIMENT

Figure 1:
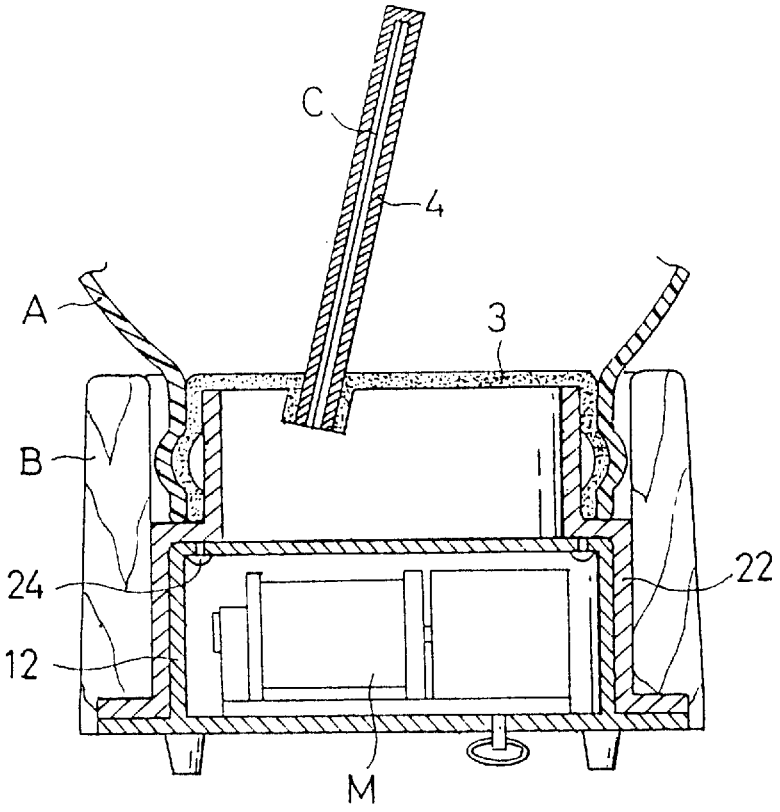
FIG. 1 is a front sectional view of the crystal ball of the present invention.
Figure 2:
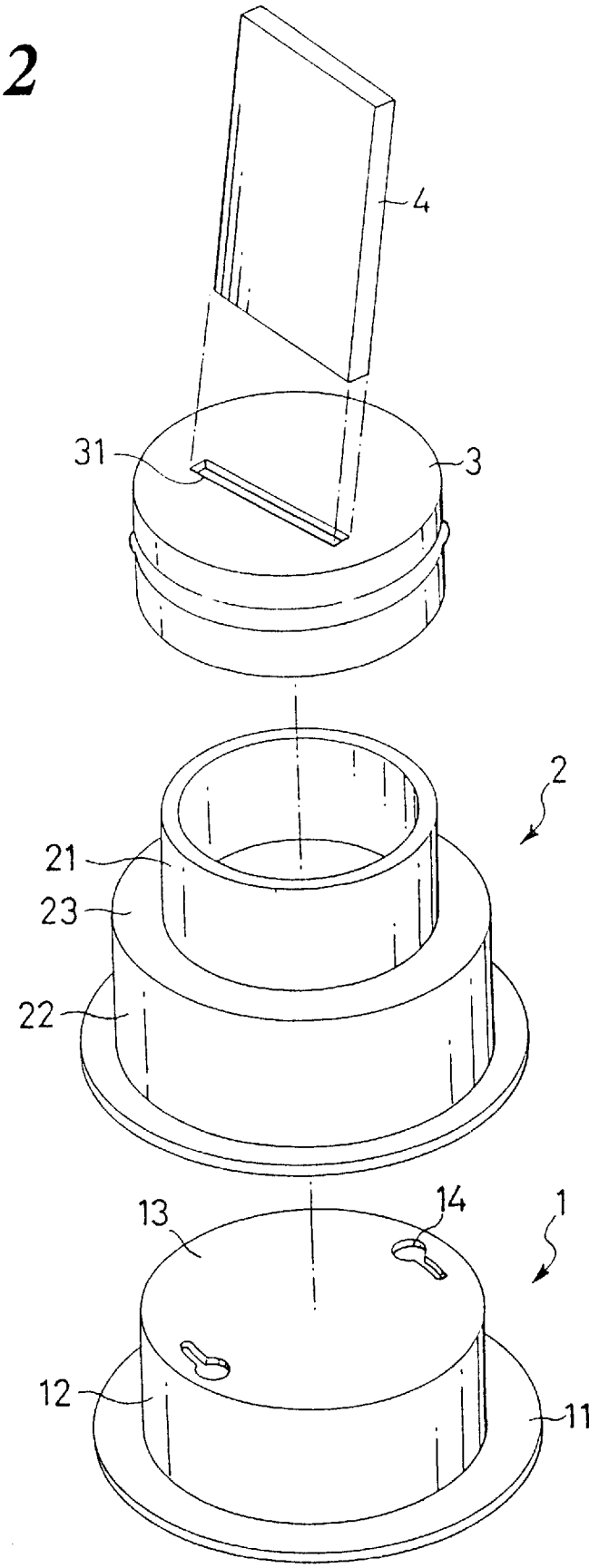
FIG. 2 is a perspective view showing the assembly of the related elements shown in FIG. 1.

Referring to FIGS. 1 and 2, the crystal ball structure of the present invention mainly comprises a base (1), a fix base (2) and a transparent box (4).

A circular cylindrical body (12) is formed on the bottom plate (11) of the base (1), a plate surface (13) is formed on the upper end face of the cylindrical body (12) and a coupling hole (14) is installed on the plate surface (13).

Furthermore, a music box (M) is fixed on the cylindrical body (12) on the base.

The fixing base (2) includes a neck portion (21) and a fixing portion (22), wherein the neck portion (21) is engaged with a rubber plug base (3). The fixed portion (22) is combined with the wood base (B) of the crystal ball to form as an integral body so that the fixing base (2) is assembled to the fixed position of the wood base (B).

Figure 3:
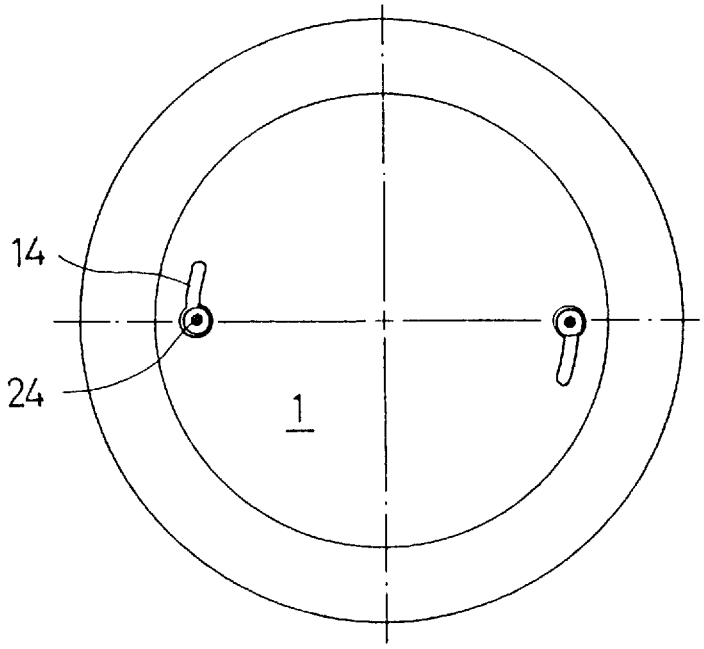
FIG. 3 is a schematic view showing the disengaged status of the coupling hole and the nose portion of the fixing base.
Figure 4:
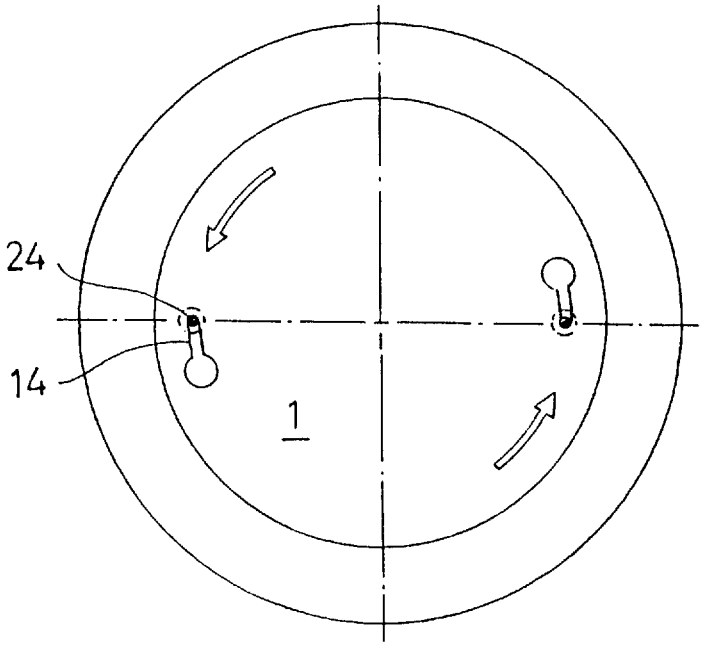
FIG. 4 is a schematic view showing the engaged status of the base and the fixing base.

A longitudinal nose portion (24) is formed on the inner side of the sectional difference portion (23) which is formed between the neck portion (21) and the fixed portion (22), wherein the nose portion (24) is correspondent to the coupling hole (14) of the base (1) as shown in FIGS. 3 and 4.

An assembly hole (31) is formed on the upper face of the rubber plug base (3) engaging with the neck portion (21) of the fixing base (2), and the assembly hole (31) is provided to assemble with the transparent box (4) so that the transparent box (4) is longitudinally extended in the inside of a globe or ball body (A).

In the present embodiment, the transparent box (4) is a rectangular hollow body, and it is formed as an open end with the end portion assembling with the assembly hole (31), therefore, the inner portion of the transparent box (4) may be inserted into a decorative plate (C), for example, a photograph, and the pattern of the decorative plate may be viewed from outside of the ball (A), further, by the enlargement characteristic of the ball (A) an enlarged image is derived.

Since the nose portion (24) of the fixing base (2) is correspondent to the coupling hole (14) of the base (1), when the cylindrical body (12) of the base (1) is engaged on the inner side of the fixed portion (22) of the fixing base (2), the nose portion (24) of the fixing base (2) is not engaged with the coupling hole (14) of the base, in FIG. 3, whereby the base (1) may be fetched out from the fixing base (2), so that the open end of the transparent box (4) is viewable. Thus, the operator can update the decorative plate (C) of the transparent box (4), therefore, the object of changing the appearance of the ball body (A) is achieved.

When the operator rotates the base (1) according to the direction of the arrow shown in FIG. 4, the nose portion (24) of the fixing base (2) will slide into the engaged position of the coupling hole (14) such that the base (1) and the fixing base (2) are combined to form an integral body.

Figure 5:
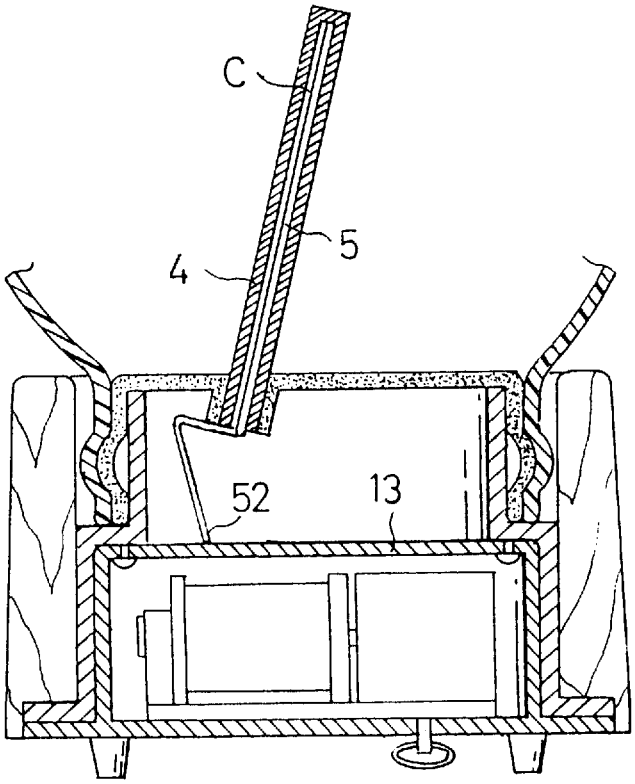
FIG. 5 shows a modified example wherein an easel is inserted into a transparent box.

In order to fix the decorative plate (C) of transparent box (4) and to present more plentiful appearances, a modified example is shown in FIG. 5, wherein an easel or support means (5), for example, a plastic plate, is inserted into the transparent box (4). The fixing plate may be fixed on one side of the easel (5), and as desired the operator may write texts or plot graphs on another face of the easel (5).

Figure 6:
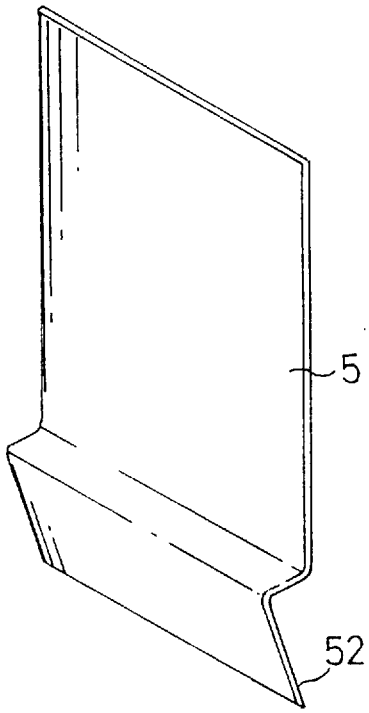
FIG. 6 is the perspective view of the easel shown in FIG. 5.

As shown in FIG. 6, in the structure of the easel (5), the easel (5) is formed on the insertable transparent box (4). The lower portion of the easel (5) with respect to the open end of transparent box (4) is formed as a curved shape, the end (52) of which is extended to contact the plate surface (13) of the base (1). By adding the easel (5), the end portion (52) of the easel (5) is supported by the plate surface (13) of the base, and curve portion is formed to prevent the decorative plate (C) to drop out of the transparent box (4).

Figure 7:
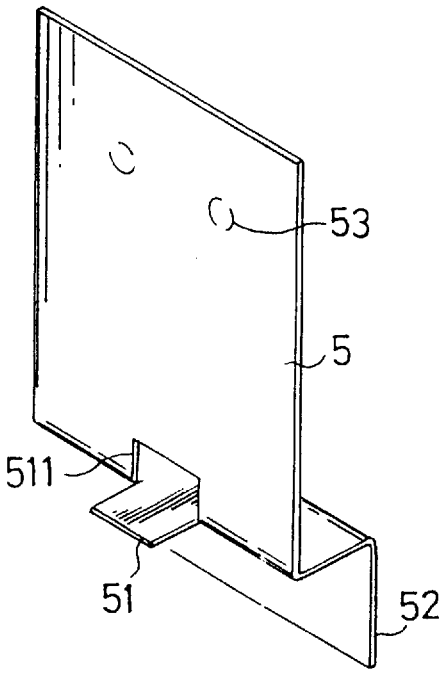
FIG. 7 is a modified example of the easel shown in FIG. 6.

Moreover, another modification of the easel (5) is shown in FIG. 7, wherein the cutting slot (511) is formed on the curved portion of the easel (5). When the curved portion is formed, a projected stop plate (51) may be formed on the opposite side of the curved portion such that the decorative plates (C) may be inserted into either side of the easel (5) and two decorative plates (C) may be used with neither capable of dropping out of the transparent box (4).

Besides, if the area of said decorative plate (C) is smaller than that of the easel (5), it is possible to prevent the decorative plate (C) from dropping to the outside of the transparent box (4) so as to avoid producing an ill effect on the outer appearance. Therefore, in the present invention, at least a convex points (53) is formed on the center portion of the upper end of the easel (5). When a smaller volume decorative plate (C) is inserted into the transparent box (4), the decorative plate (C) can be clamped by the convex points (53) so as to prevent the decorative plate (C) from dropping out the lower portion of the transparent box (4).

Figure 8:
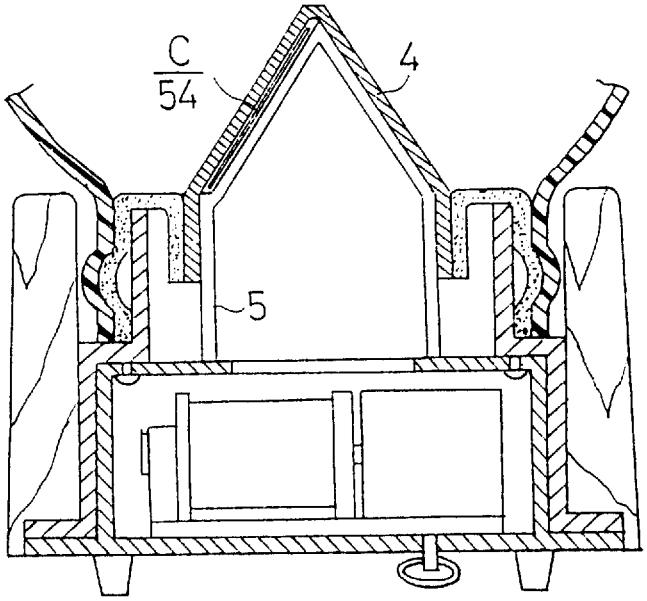
FIG. 8 is a modified embodiment of a transparent box shown in FIG. 1.

Since the transparent box (4) is thin and flat, in order that the transparent box (4) may have a beautiful appearance, as shown in FIG. 8, the transparent box (4) may also be conical shape. At the same time, for matching the shape of the transparent box (4), the shape of the easel (5) is designed with respect to that of the transparent box (4), and convex space (54) for holding the decorative plate is formed on one or two sides adjacent to the transparent box (4), further, the lower side of the easel (5) is in contact with the plate surface (13) of the base so to provide support thereon.

Figure 9:
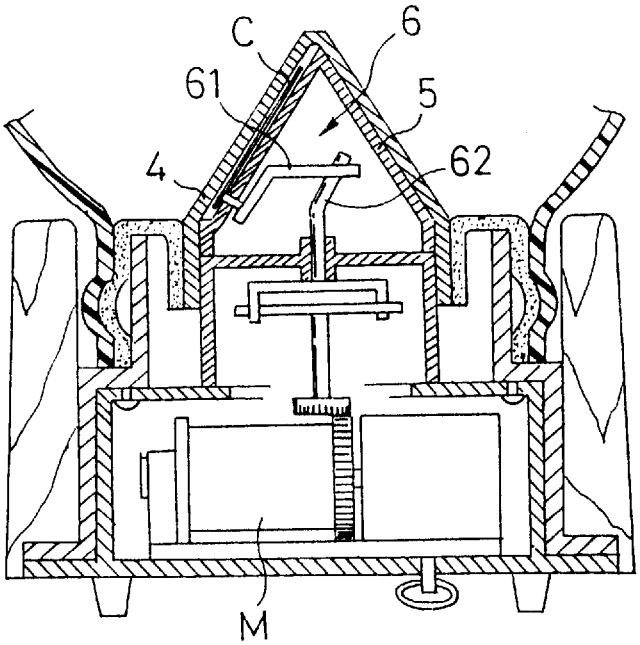
FIG. 9 is a modified embodiment of embodiment shown in FIG. 8.
Figure 10:
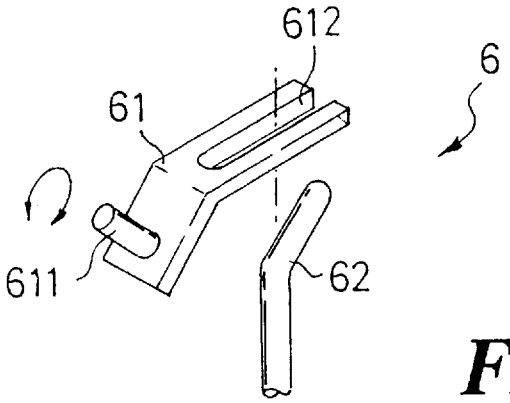
FIG. 10 shows the perspective assembled view of a vibrating rod and an eccentric shaft.

The decorative plates (C) installed in the transparent box (4) is formed with fixed shape. In order to present dynamic variations inside the crystal ball (A), a driven mechanism (6) is installed within the range of the easel (5), as shown in FIGS. 9 and 10. The driven mechanism (6) includes a vibrating rod (61) and an eccentric shaft (62), wherein a rotary shaft (611), which is penetrating into the convex space (54) of the easel (5), is installed on one end of the vibrating rod (61). The front end of the rotary shaft (611) is connected with the decorative plate (C), and an oblong opening (612) is formed on another side of the vibrating rod (61).

Moreover, the eccentric shaft is installed in the longitudinal position and may be driven by the music box (M) and other related elements to rotate, and since the end portion of the eccentric shaft (62) is positioned on the oblong opening (612) of the vibrating rod (61). The vibrating rod (61) may be driven by the eccentric shaft (611) so as to vibrate forwards and backwards around the rotary shaft, thus the decorative plate (C) positioned between the transparent box (4) and the convex space (54) is also synchronously moved.

In order that the decorative plate (C) may present dynamic appearances, the area of the decorative plate (C) is adjusted with respect to the area of the convex space (54).

Figure 11:
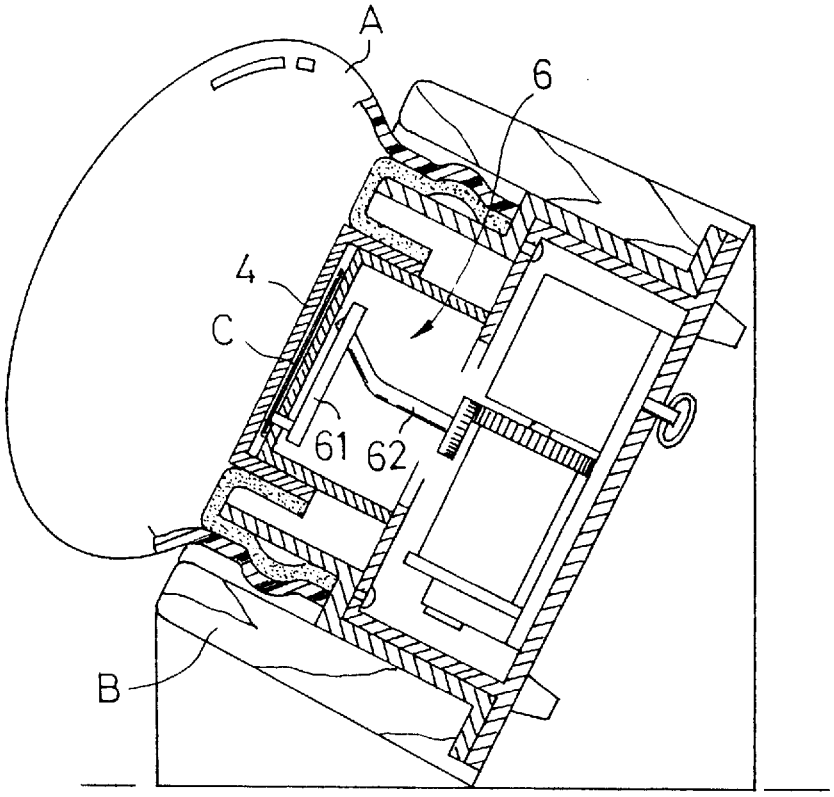
FIG. 11 is another modified embodiment of embodiment in the FIG. 1.

Although the transparent box (4) is installed inside the ball (A), the type of transparent box (4) may also be changed to be aligned with the rubber plug base (3), as shown in the FIG. 11, so as to correspond with sloping wood base (B) of the crystal ball, thus the decorative plate (C) between the transparent box (4) and the easel (5) may be presented at a proper angle.

A driven device can be installed within the range of the easel (5) so that the decorative plate (C) can be driven by the driven mechanism (6) so as to present dynamic appearances.

What is claimed is:

1. A crystal ball structure having a changeable ball appearance, said crystal ball structure comprising:

a base including a bottom plate, a cylindrical body fixed to said bottom plate, said cylindrical body having an upper portion, and a plate surface covering the upper portion of said cylindrical body, said plate surface having a coupling hole passing therethrough;

a fixing base fitting over said base, said fixing base including a nose portion on an inside of said fixing base, said nose portion extending through said coupling hole and engaging said plate surface;

a fixed portion fitting over said cylindrical body of said base, a sectional difference portion extending inward from said fixed portion, and a neck portion extending up from said sectional difference portion;

a rubber plug base fitting around said neck portion of said fixing base, said rubber plug base having an assembly hole passing therethrough;

a transparent box in communication with said assembly hole of said rubber plug base, said transparent box having an open end passing therethrough;

a support means in said transparent box for supporting a decorative plate within said transparent box; and a globe joined with said rubber plug base to form a liquid tight seal, whereby said transparent box and said support means extend from said rubber plug base into said globe.

2. A crystal ball structure with changeable ball appearance as recited in claim 1, wherein the decorative plate resting in said transparent box is observable through said globe.

3. A crystal ball structure with changeable ball appearance as recited in claim 1, wherein a lower end portion of said support means with respect to the open end of said transparent box is curved.

4. A crystal ball structure with changeable ball appearance as recited in claim 3, wherein a stopping plate is formed on a side opposite the curved lower end portion of said support means.

5. A crystal ball structure with changeable ball appearance as recited in claim 3, wherein at least one convex portion is formed in a center region at an end opposite the curved lower end portion of said support means.

6. A crystal ball structure with changeable ball appearance, said crystal ball structure comprising:

a base including a bottom plate, a cylindrical body fixed to said bottom plate, said cylindrical body having an upper portion, and a plate surface covering the upper portion of said cylindrical body, said plate surface having a coupling hole passing therethrough;

a fixing base fitting over said base, said fixing base including a nose portion on an inside of said fixing base, said nose portion extending through said coupling hole and engaging said plate surface;

a fixed portion fitting over said cylindrical body of said base, a sectional difference portion extending inward from said fixed portion, and a neck portion extending up from said sectional difference portion;

a rubber plug base fitting around said neck portion of said fixing base, said rubber plug base having an assembly hole passing therethrough;

a transparent box in communication with said assembly hole of said rubber plug base, said transparent box having an open end passing therethrough;

a support means for insertion into said transparent box, said support means having an end portion adjoining said plate surface of said base for support thereon and a convex space for holding a decorative plate within said transparent box;

a music box in said cylindrical body of said base;

a driven mechanism is located within range of said support means and is connected to said music box, said driven mechanism being driven by said music box for providing movement for the decorative plate; and a globe joined with said rubber plug base to form a liquid tight seal, whereby said transparent box, the decorative plate, and said support means extend from said rubber plug base into said globe.

7. A crystal ball structure with changeable ball appearance as recited in claim 6, wherein said driven mechanism including a vibrating rod in connection with the decorative plate and an eccentric shaft connected to said vibrating rod and said music box.

8. A crystal ball structure with changeable ball appearance as recited in claim 7, wherein said driven mechanism further including a rotary shaft attached to said vibrating rod, said rotary shaft penetrates the convex space of said support means, said rotary shaft having a front end in communication with the decorative plate, and said vibrating rod having an oblong opening formed on another side.

9. The crystal ball structure with changeable ball appearance as recited in claim 7, wherein said eccentric shaft is driven by said music box to rotate, and an end portion of said eccentric shaft in communication with an oblong groove of said vibrating rod.

* * * * *